US012691325B2

(12) United States Patent
Hu

(10) Patent No.: US 12,691,325 B2
(45) Date of Patent: Jul. 28, 2026

(54) LIFTING STRUCTURE FOR PLATFORM OF TREADMILL

(71) Applicant: Yongkang Saihan Electronic Technology Co Ltd., Zhejiang (CN)

(72) Inventor: Jiachen Hu, Zhejiang (CN)

(73) Assignee: Yongkang Saihan Electronic Technology Co Ltd., Jinhua (CN)

( * ) Notice: Subject to any disclaimer, the term of this patent is extended or adjusted under 35 U.S.C. 154(b) by 114 days.

(21) Appl. No.: 18/677,792

(22) Filed: May 29, 2024

(65) Prior Publication Data

US 2025/0186829 A1 Jun. 12, 2025

(30) Foreign Application Priority Data

Dec. 7, 2023 (CN) ..... 202323327768.3

(51) Int. Cl.
*A63B 22/02* (2006.01)
*A63B 22/00* (2006.01)

(52) U.S. Cl.
CPC ..... *A63B 22/02* (2013.01); *A63B 22/0023* (2013.01)

(58) Field of Classification Search
CPC .. A63B 22/0023; A63B 22/02; A63B 22/0235
See application file for complete search history.

(56) References Cited

U.S. PATENT DOCUMENTS

| | | | | |
|---|---|---|---|---|
| 5,607,375 | A * | 3/1997 | Dalebout | A63B 22/0023 482/52 |
| 6,743,155 | B2 * | 6/2004 | Pan | A63B 22/0023 482/54 |
| 10,603,538 | B2 * | 3/2020 | Netter | A63B 22/0235 |
| 2013/0231219 | A1 * | 9/2013 | Huang | A63B 22/0023 482/54 |
| 2024/0399196 | A1 * | 12/2024 | Miao | A63B 22/02 |
| 2025/0082985 | A1 * | 3/2025 | Liu | A63B 22/02 |

* cited by examiner

*Primary Examiner* — Megan Anderson

(57) ABSTRACT

Disclosed in the present invention is a lifting structure for a platform of a treadmill, including lifting units rotatably connected to a treadmill support, the lifting unit having a first position for lifting a front end of the treadmill support after the lifting unit is unfolded and a second position for making a lower edge of the lifting unit higher than or flush with support surfaces of support legs and/or support wheels of the treadmill after the lifting unit is folded.

8 Claims, 4 Drawing Sheets

LIFTING STRUCTURE FOR PLATFORM OF TREADMILL

TECHNICAL FIELD

The present invention relates to the technical field of fitness equipment, and more particularly to a lifting structure for a platform of a treadmill.

BACKGROUND

The existing treadmill includes a main frame as a base, a platform mounted on the main frame, armrests and a control platform. The platform is fixed on the base in parallel to form an exercise plane for walking or running, and when the exercise plane is used, the climbing exercise function can be realized through a lifting mechanism.

For example, a lifting structure for a treadmill, the Chinese patent document CN219941696U previously applied, solves the technical problems existing in the prior art, and a simple structure can be used to realize the lifting of the platform of the treadmill, with the disadvantage that a certain space is still occupied after the lifting structure is folded.

For a treadmill with a relatively high ground clearance from a bottom of a platform, this method does not affect the specific use. Because support legs of such a treadmill are relatively high, the ground clearance is sufficient to accommodate a lifting piece occupying a certain space. However, for a treadmill with a low ground clearance, this structure is not applicable. After this structure is mounted, the ground clearance is at least the sum of the height of a first unit 1 and the partial height of a second unit 2. Therefore, further improvements are made.

SUMMARY

Aiming at the shortcomings in the prior art, the present invention provides a lifting structure for a platform of a treadmill, lifting units of which occupy less space in a height direction after being folded, and are more suitable for a treadmill with a lower ground clearance.

In order to solve the above technical problems, the present invention provides the following technical solutions.

A lifting structure for a platform of a treadmill includes lifting units rotatably connected to a treadmill support, the lifting unit having a first position for lifting a front end of the treadmill support after the lifting unit is unfolded and a second position for making a lower edge of the lifting unit higher than or flush with support surfaces of support legs and/or support wheels of the treadmill after the lifting unit is folded.

In the above solution, preferably, the lifting unit includes a slot for containing a corresponding portion of the treadmill support.

In the above solution, preferably, the lifting unit includes a first wall and two second walls arranged on two sides of the first wall, and the slot for containing the corresponding portion of the treadmill support is formed between the two second walls.

In the above solution, preferably, the spacing between the two second walls matches a width of a side connecting rod of the treadmill support.

In the above solution, preferably, upper portions of front ends of the second walls are fitted at a position above a middle part of the side connecting rod of the treadmill support by means of a fastener or a pin.

In the above solution, preferably, a front end wall of the first wall is a flat wall; and when the lifting unit is in the first position, the front end wall is attached to a bottom surface of the treadmill support.

In the above solution, preferably, an inner side wall of the first wall is a flat wall; and when the lifting unit is in the second position, the inner side wall is attached to the bottom surface of the treadmill support.

In the above solution, preferably, a front end of the lifting unit includes avoidance space for avoiding the treadmill support when the lifting unit is in the first position.

In the above solution, preferably, the lifting unit is fitted to the treadmill support by the fastener or the pin.

In the above solution, preferably, the first wall and the two second walls are integrally formed.

The present invention has the following advantageous effects.

The lifting units of the present invention after being unfolded can lift the front ends of the treadmill to achieve climbing exercises. The lifting units are attached to and stored on the treadmill support after being folded, which only exceed thickness dimensions of the first walls in the height direction compared with the treadmill support, occupy smaller space, and are more suitable for a treadmill with a lower ground clearance, making the whole treadmill more beautiful and concise.

DETAILED DESCRIPTION

The present invention is further described in detail with the attached drawings and specific implementations.

Figure 1:
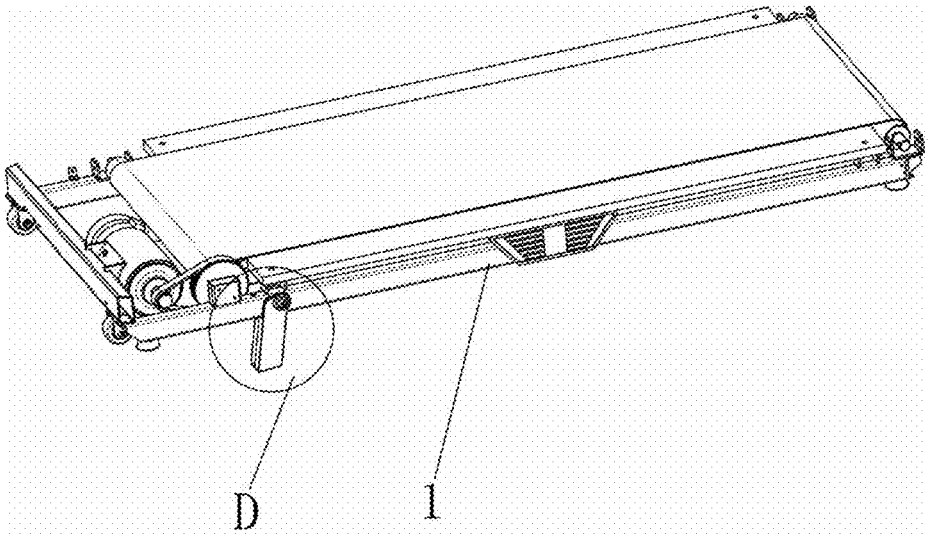
FIG. 1 is a schematic diagram showing an unfolded state of a lifting unit according to the present invention.
Figure 2:
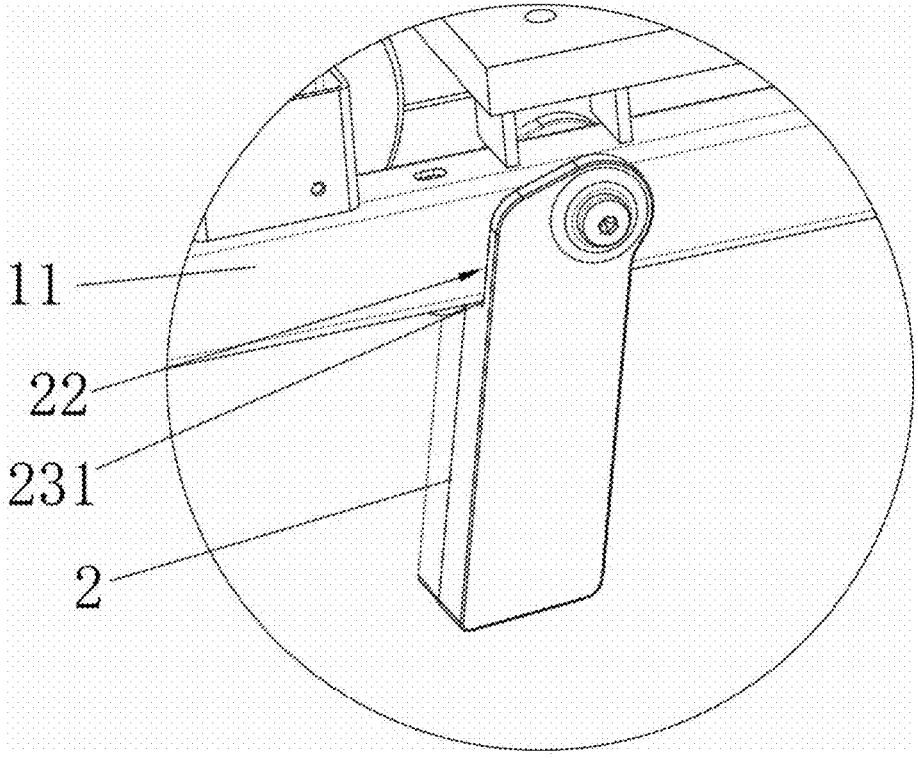
FIG. 2 is an enlarged schematic diagram at D in FIG. 1.
Figure 3:
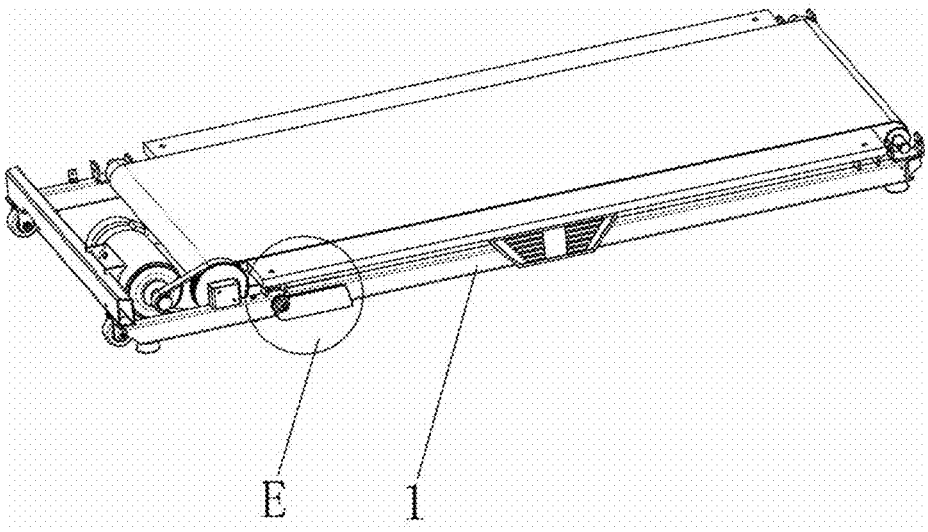
FIG. 3 is a schematic diagram showing a folded state of the lifting unit according to the present invention.
Figure 4:
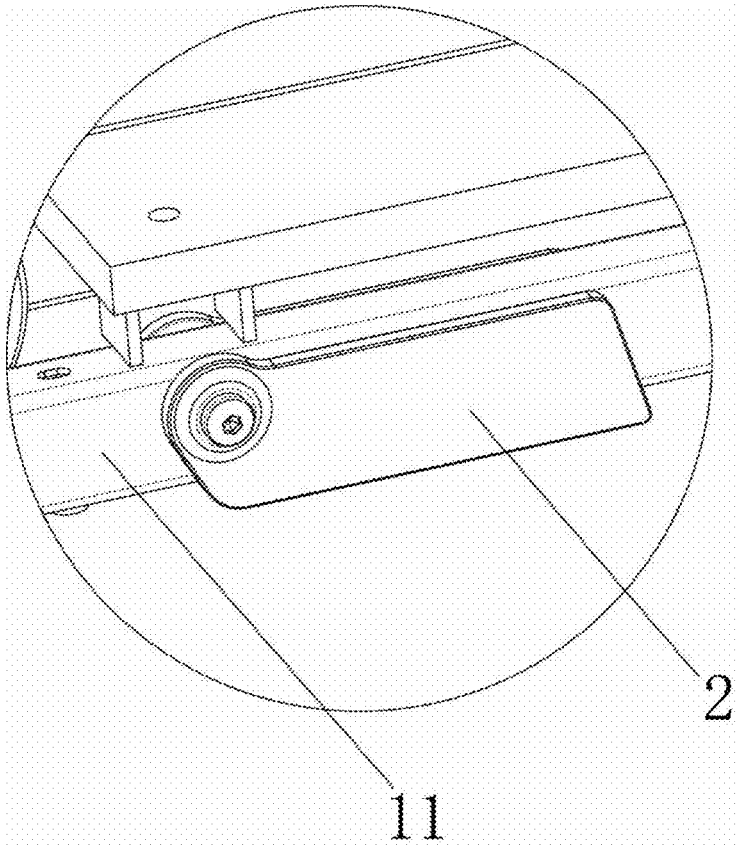
FIG. 4 is an enlarged schematic diagram at E in FIG. 3.
Figure 5:
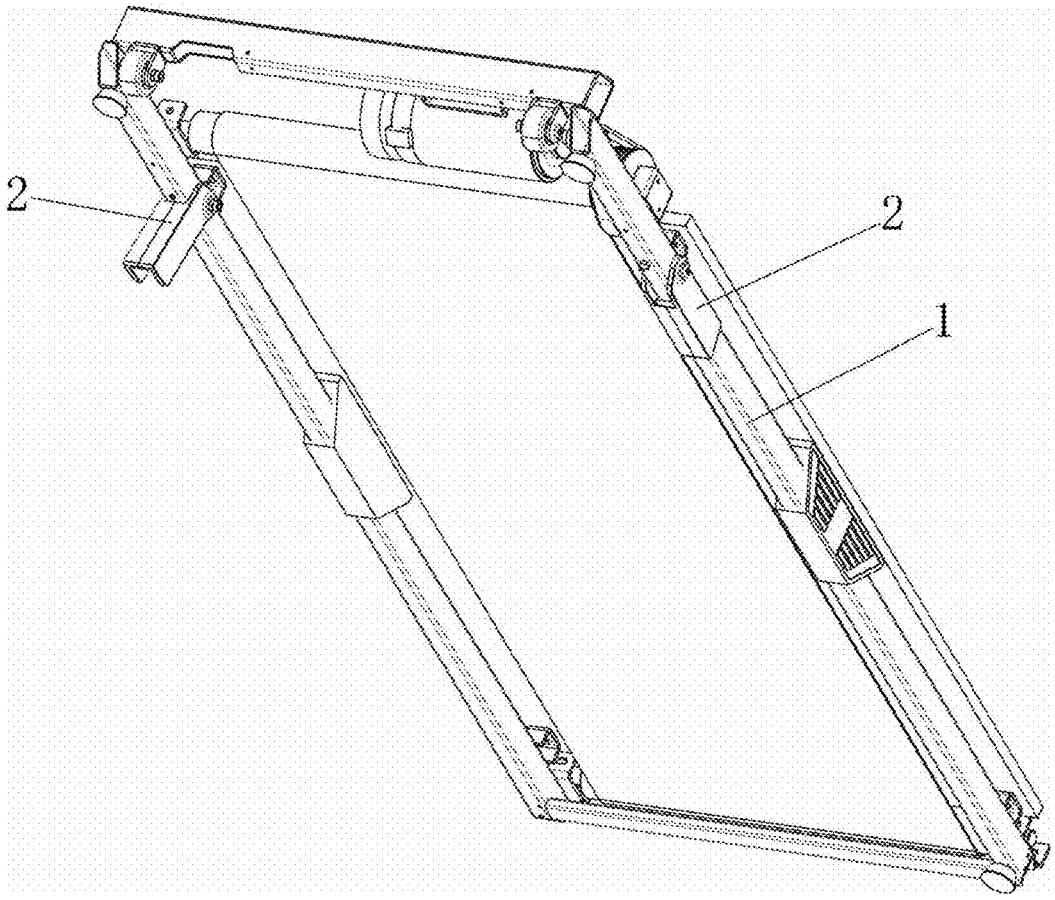
FIG. 5 is a schematic diagram showing a state where the lifting unit is mounted on a treadmill support according to the present invention.

Referring to FIGS. 1-8, a lifting structure for a platform of a treadmill includes lifting units 2 rotatably connected to a treadmill support 1. The lifting units 2 are manually or automatically turned along corresponding rotational connection points. The lifting units 2 are used for lifting front ends of the treadmill after the lifting units 2 are turned outwards and unfolded, which are in a first position, as shown in FIGS. 1 and 2, providing a climbing exercise mode for a user; and the treadmill is returned to an initial state after the lifting units 2 are turned and folded inwards, as a flat running training mode, which are in a second position, as shown in FIGS. 3 and 4.

The main design point of the present application is that most parts can be overlapped on the treadmill support 1 after the lifting units 2 are folded, and there is less space occupation influence in a height direction, which is mainly based on the fact that the lifting units 2 have slots 21 capable of containing corresponding portions of the treadmill support 1 and avoidance space 22 capable of avoiding the treadmill support 1 after the lifting units 2 are unfolded.

Figure 7:
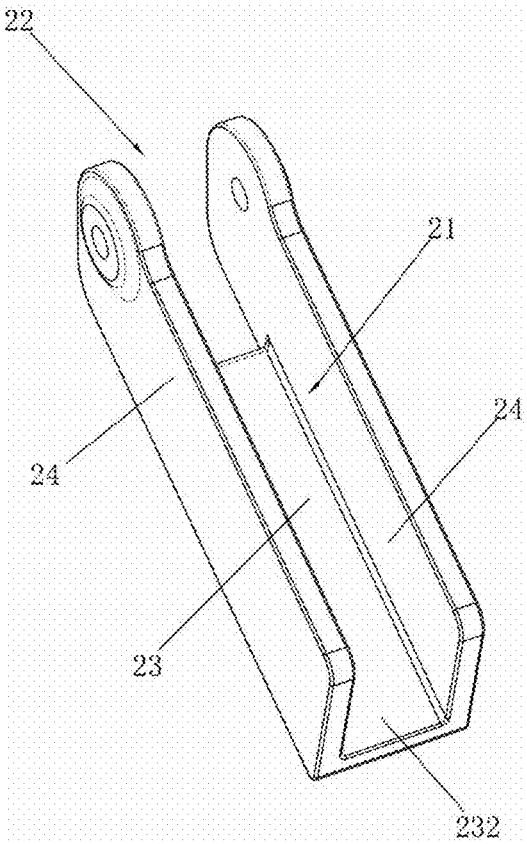
FIG. 7 is a schematic diagram of the lifting unit according to the present invention.

Specifically, the lifting unit 2 includes a first wall 23 and two second walls 24 arranged on two sides of the first wall 23. In an alternative, both the first wall 23 and the second wall 24 are of a plate-like structure, and the first wall 23 and the two second walls 24 are integrally formed, as shown in FIGS. 7 and 8.

The slot 21 is defined by the two second walls 24, that is, the spacing space formed between the two second walls 24 is a slot. After the lifting unit 2 is folded, the two second walls 24 are located on two sides of a side connecting rod 11 of the treadmill support 1. In an alternative, the spacing between the two second walls 24 matches a width of the side connecting rod 11 of the treadmill support 1. For example, after the lifting unit 2 is folded, inner walls of the two second walls 24 are attached to or near to be attached to the side connecting rod 11, with smaller spacing.

Figure 8:
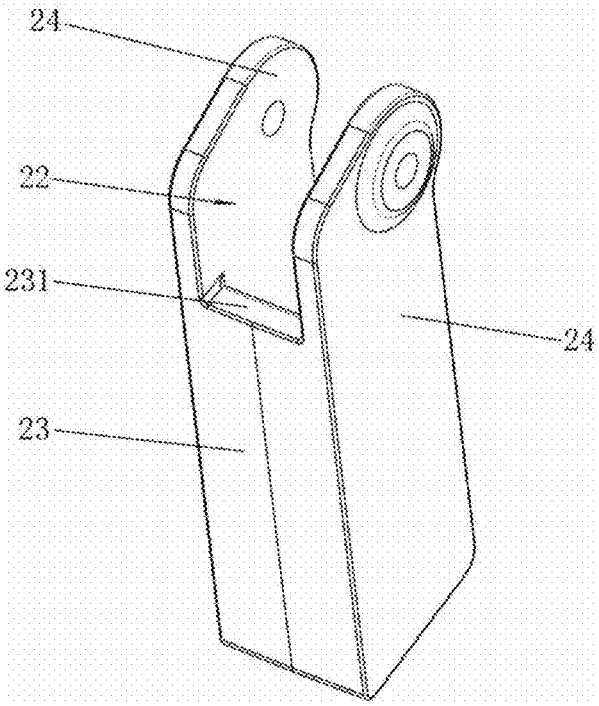
FIG. 8 is a schematic diagram of the lifting unit from another perspective according to the present invention.

With regard to the avoidance space, as shown in FIGS. 2 and 8, a front end of the first wall 23 is not flush with front ends of the second walls 24, and a certain distance is left between the front end of the first wall 23 and the front ends of the second walls 24, in combination with the design of the slot 21, to form the corresponding avoidance space, so that there is sufficient space for the lifting unit 2 to turn to a position where it can stably support the treadmill when the lifting unit 2 is unfolded.

In order to make the lifting unit 2 more stable when unfolded, a front end wall 231 of the first wall 23 is a flat wall in the example, and when the lifting unit 2 is in the first position, the front end wall 231 is attached to a bottom surface of the side connecting rod 11 of the treadmill support 1.

In order to minimize the space occupied in the height direction after the lifting unit 2 is folded, in the example, an inner side wall 232 of the first wall 23 is a flat wall, and when the lifting unit 2 is in the second position, the inner side wall 232 is attached to the bottom surface of the side connecting rod 11 of the treadmill support 1.

There may be various ways for the rotational connection of the lifting unit 2 to the treadmill support 1. For example, a tool, such as a bolt or a pin, sequentially passes through a hole on one second wall 24, a hole on the side connecting rod 11 of the treadmill support 1 and a hole on the other second wall 24, and then is threadedly connected to a nut to position the lifting unit and make it rotate relative to a screw.

With regard to the rotational connection position of the lifting unit 2, in an alternative, an upper portion of the front end of the second wall 24 is fitted above a middle part of the side connecting rod 11 of the treadmill support 1 by means of the fastener or the pin. The layout of this position can reduce the space occupied by the lifting unit in the height direction after being folded.

Figure 6:
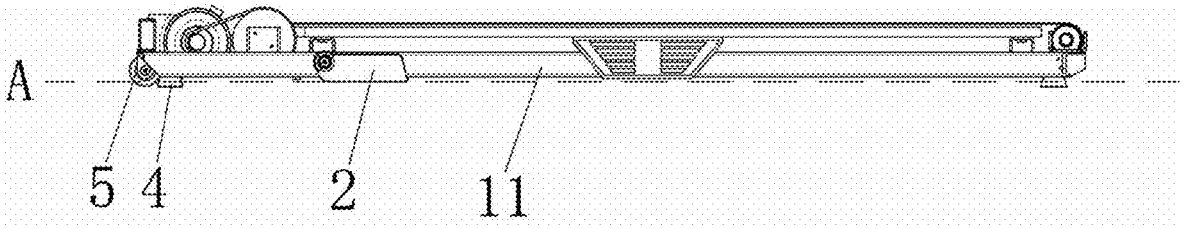
FIG. 6 is a schematic diagram of a height of the lifting unit in the folded state according to the present invention.

As shown in FIG. 6, a height line of the lower edge of the lifting unit designed in the present application in a folded state: line A, is higher than the height of support surfaces of support legs 4 and support wheels 5 of the treadmill. The space occupied by the lifting unit 2 in the height direction is only a thickness of the first wall 23, which is more suitable for a treadmill with a lower ground clearance, making the whole treadmill more beautiful and concise.

The invention claimed is:

1. A lifting structure for a platform of a treadmill, comprising lifting units rotatably connected to a treadmill support, the lifting units having a first position for lifting a front end of the treadmill support and a second position for making a lower edge of each of the lifting units higher than support surfaces of support legs and/or support wheels of the treadmill;

wherein the lifting units are configured to be adjusted to the first position to provide climbing exercise, and be adjusted to the second position to provide flat running training;

wherein each of the lifting units comprises a slot for containing a side connecting rod of the treadmill support;

wherein each of the lifting units comprises a first wall and two second walls arranged on two sides of the first wall, and the slot is formed between the two second walls, and configured for containing the side connecting rod of the treadmill support;

wherein upper portions of front ends of the second walls are directly fitted at a position above a middle part of the side connecting rod of the treadmill support by means of a fastener or a pin;

wherein a front end of each of the lifting units comprises avoidance space for avoiding the side connecting rod when the lifting units are in the first position, and a certain distance is left between the front end of the first wall and the front ends of the second walls to form the avoidance space.

2. The lifting structure for a platform of a treadmill according to claim 1, wherein the spacing between the two second walls matches a width of a side connecting rod of the treadmill support.

3. The lifting structure for a platform of a treadmill according to claim 2, wherein a front end wall of the first wall is a flat wall; and when the lifting units are in the first position, the front end wall is attached to a bottom surface of the side connecting rod.

4. The lifting structure for a platform of a treadmill according to claim 2, wherein an inner side wall of the first wall is a flat wall; and when the lifting units are in the second position, the inner side wall is attached to the bottom surface of the side connecting rod.

5. The lifting structure for a platform of a treadmill according to claim 1, wherein the first wall and the two second walls are integrally formed.

6. The lifting structure for a platform of a treadmill according to claim 1, wherein a front end wall of the first wall is a flat wall; and when the lifting units are in the first position, the front end wall is attached to a bottom surface of the side connecting rod.

7. The lifting structure for a platform of a treadmill according to claim 1, wherein an inner side wall of the first wall is a flat wall; and when the lifting units are in the second position, the inner side wall is attached to the bottom surface of the side connecting rod.

8. The lifting structure for a platform of a treadmill according to claim 1, wherein the lifting units are fitted to the treadmill support by the fastener or the pin.

* * * * *